US007937767B2

(12) United States Patent
Leach et al.

(10) Patent No.: US 7,937,767 B2
(45) Date of Patent: May 10, 2011

(54) SPORTS PANT WITH OUTER SHELL AND SOCK ATTACHMENT SYSTEM

(75) Inventors: Keith Leach, Montréal (CA); Sylvie Bedard, Montréal (CA)

(73) Assignee: Sport Maska Inc., Montreal, Quebec (CA)

( * ) Notice: Subject to any disclaimer, the term of this patent is extended or adjusted under 35 U.S.C. 154(b) by 522 days.

(21) Appl. No.: 11/374,177

(22) Filed: Mar. 14, 2006

(65) Prior Publication Data

US 2007/0234467 A1 Oct. 11, 2007

(51) Int. Cl.
*A41D 13/00* (2006.01)
*A41D 13/06* (2006.01)

(52) U.S. Cl. ..... 2/22

(58) Field of Classification Search ..... 2/22, 23, 2/79, 227, 228, 267, 69, 232, 309, 270, 911, 2/919

See application file for complete search history.

(56) References Cited

U.S. PATENT DOCUMENTS

| | | | | |
|---|---|---|---|---|
| 1,669,085 | A | 5/1928 | Guyon | |
| 3,266,057 | A | 8/1966 | Phelps | |
| 3,594,817 | A * | 7/1971 | Kelly | 2/456 |
| 4,215,435 | A | 8/1980 | Miele | |
| 4,325,148 | A * | 4/1982 | Livernois | 2/465 |
| 4,766,613 | A | 8/1988 | Wells | |
| 4,811,427 | A | 3/1989 | Regan | |
| 5,182,812 | A | 2/1993 | Goldsby | |
| 5,539,927 | A | 7/1996 | Holubec | |
| 5,581,817 | A | 12/1996 | Hicks | |
| 5,608,915 | A | 3/1997 | Libit | |
| 5,717,996 | A | 2/1998 | Feldmann | |
| D394,543 | S | 5/1998 | Lindaman | |
| D395,158 | S | 6/1998 | Lindaman | |
| 5,774,892 | A | 7/1998 | Trisdale et al. | |
| 5,864,888 | A | 2/1999 | Archer | |
| 5,926,856 | A | 7/1999 | Duval | |
| 6,023,789 | A * | 2/2000 | Wilson et al. | 2/228 |
| 6,701,533 | B2 | 3/2004 | Webb | |
| 6,782,559 | B2 | 8/2004 | Regan | |
| 6,804,832 | B2 * | 10/2004 | Beland | 2/227 |
| 6,978,484 | B2 | 12/2005 | Donlan et al. | |
| 7,237,270 | B2 | 7/2007 | Crye et al. | |
| 2002/0178483 | A1 | 12/2002 | Beland | |
| 2003/0056275 | A1 * | 3/2003 | Regan | 2/78.1 |
| 2003/0093852 | A1 | 5/2003 | Webb | |
| 2005/0076421 | A1 | 4/2005 | Littzi | |
| 2006/0282938 | A1 * | 12/2006 | Jewell et al. | 2/227 |
| 2007/0101474 | A1 * | 5/2007 | Skottheim et al. | 2/69 |

FOREIGN PATENT DOCUMENTS

| | | |
|---|---|---|
| CA | 2076131 | 2/1994 |
| CA | 2130644 | 7/1996 |

* cited by examiner

*Primary Examiner* — Gary L Welch
*Assistant Examiner* — Amber R Anderson
(74) *Attorney, Agent, or Firm* — Ogilvy Renault LLP

(57) ABSTRACT

A garment including a pant having at least one attachment member integral with each leg portion proximal the open end thereof and forming one half of a detachable attachment system. A kit further includes a pair of socks each having at least one attachment member extending therefrom, the attachment members of the socks and pants being complementary for forming a detachable connection. Also, a garment including an inner pant having an inner torso portion, two inner leg portions, and at least one protective pad, and an outer pant retainable around the inner pant and having an outer torso portion covering the inner torso portion, two tubular outer leg portions enclosing the inner leg portions, the outer pant being independent from the inner pant.

22 Claims, 4 Drawing Sheets

SPORTS PANT WITH OUTER SHELL AND SOCK ATTACHMENT SYSTEM

BACKGROUND OF THE INVENTION

1. Field of the Invention

The present invention relates generally to sports equipment, particularly to pants and socks which are commonly used in the games of ice hockey, street hockey, in-line skate hockey and the like.

2. Background Art

Many sports, in particular ice hockey, require the use of protective equipment on the lower torso and legs of a player, such as padded pants and shin pads. The padded pants are generally relatively expensive, and form part of a player's uniform. Accordingly, a player requiring more than one uniform of different team colors will usually require a different pair of padded pants for each uniform, which substantially increases the cost of the hockey equipment.

Typically, the shin pads are generally covered with a sock, which may be in the shape of an elongated tube slipped on over the shin pad, with or without an end foot portion enclosing the player's foot, and which usually covers the leg from the ankle up to the upper thigh. Socks may typically be made of knitted material, and may comprise a number of elastic-type fabrics, such as Lycra, nylon or any other appropriate material or combination thereof. Typically however, socks will, through the skating action of a player, tend to fall down.

Traditionally, hockey socks have been held up through the use of garter belt systems, whereby a garter is strapped to the waist of a player, under the padded pants, and the socks are attached thereto. Garter belt systems are generally relatively complex to use, as the padded pants must be removed to put on, remove or adjust the garter belt. In addition, the clips retaining the socks can be uncomfortable against the player's legs. Garters do not meet with the approval of all players.

Other known systems for retaining the socks include the presence of a hook type fastener on the outside of underpants which engages the fabric of the socks. However, such a system is not adapted for all types of socks, as some types of fabric cannot be directly and efficiently engaged to a hook type fastener. In addition, such a system usually necessitate wearing an additional layer of clothing, namely the underpants, under the protective pants and other equipment.

SUMMARY OF INVENTION

It is therefore an aim of the present invention to provide an improved hockey pant which can be used with different color uniforms.

It is also an aim of the present invention to provide an improved sock attachment system which is relatively easy to use.

Therefore, in accordance with the present invention, there is provided a garment comprising a pant having a torso portion adapted to cover a lower torso of a wearer, two tubular leg portions extending from the torso portion in communication therewith to cover upper legs of the wearer, the leg portions each having an open end opposed from the torso portion, means for retaining the pant in place around the torso, at least one of hip protective pads, a lower back protective pad and thigh protective pads, and at least one attachment member integral with each of the leg portions proximal the open end thereof and forming one half of a detachable attachment system.

Also in accordance with the present invention, there is provided a kit comprising a pair of socks, each of the socks comprising at least one first attachment member extending from an upper portion thereof, and a pant having a torso portion, two tubular leg portions extending from the torso portion in communication therewith and means for retaining the pant in place around a body of a wearer, at least one of the torso portion and leg portion including at least one protective pad, the leg portions each having an open end opposed from the torso portion, each of the leg portions including at least one second attachment member for each first attachment member of a corresponding one of the socks, the second attachment member being integral with the leg portion proximal the open end and being complementary to the corresponding first attachment member for forming a detachable connection.

Further in accordance with the present invention, there is provided a garment comprising an inner pant having an inner torso portion adapted to cover a lower torso of a wearer, two tubular inner leg portions extending from the inner torso portion and in communication therewith to enclose legs of the wearer, means for retaining the inner pant in place around the torso, and at least one protective pad for protecting a selected portion of at least one of the lower torso and legs of the wearer, and an outer pant having an outer torso portion covering the inner torso portion, two tubular outer leg portions extending from the outer torso portion and in communication therewith to enclose the inner leg portions and means for retaining the outer pant in place around the inner pant, the outer pant being independent from the inner pant.

BRIEF DESCRIPTION OF THE DRAWINGS

Reference will now be made to the accompanying drawings, showing by way of illustration a particular embodiment of the present invention and in which.

DETAILED DESCRIPTION OF PARTICULAR EMBODIMENTS

Figure 1:
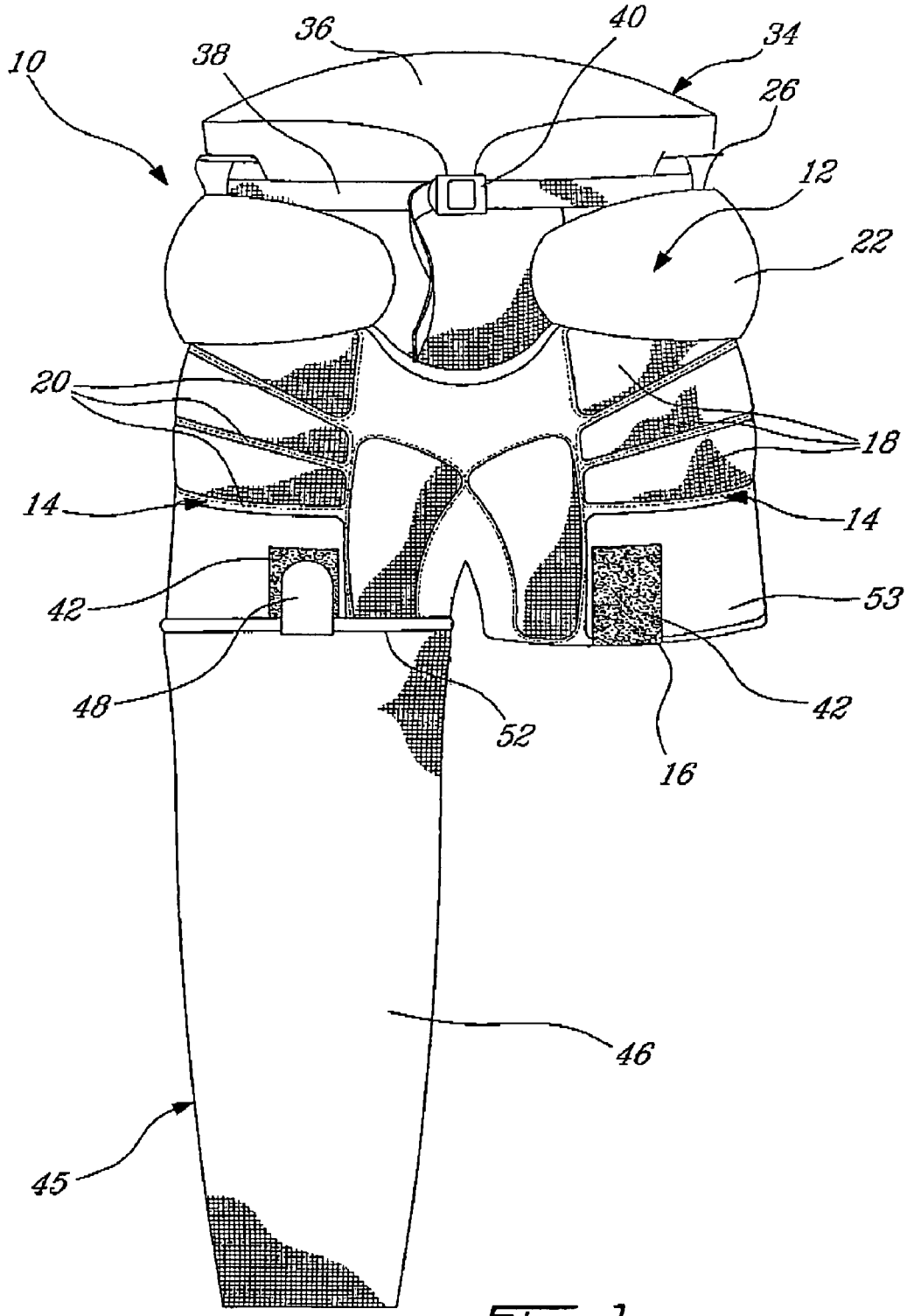
FIG. 1 is a front view of a hockey pant and a portion of one sock according to a particular embodiment of the present invention.
Figure 2:
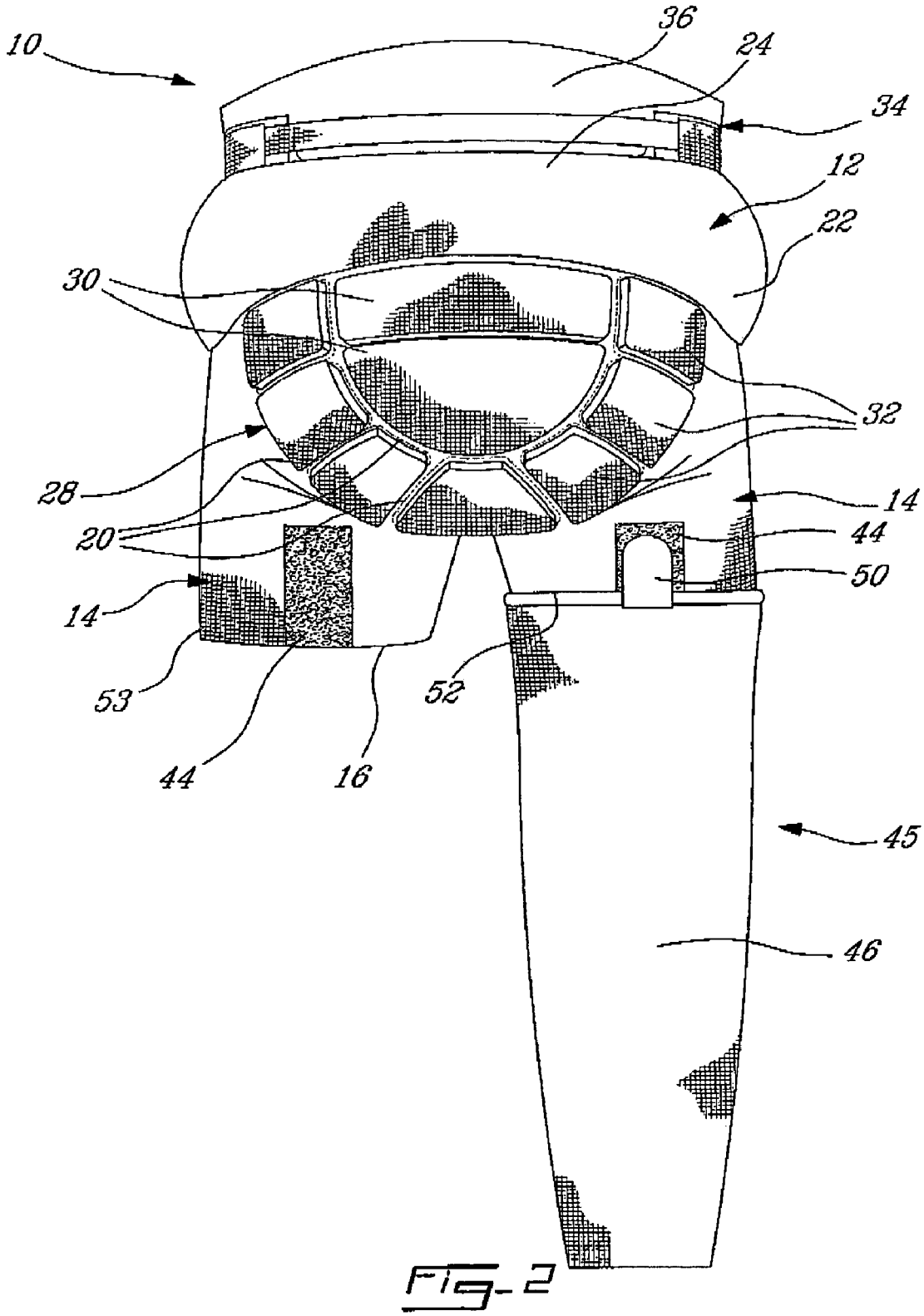
FIG. 2 is a rear view of the hockey pant and sock portion of FIG. 1.

Referring now to FIGS. 1-2, a pant according to a particular embodiment of the present invention is generally shown at 10. Although the pant 10 is generally described herein with reference to hockey, it is understood that the pant is also adapted for multiple other contact sports and activities.

The pant 10 includes generally a torso portion 12, which has a substantially tubular form, and a pair of leg portions 14, which also have a substantially tubular form and which extend from the torso portion 12 in communication therewith. Each leg portion 14 has an open end 16 defined opposite of the torso portion 12. The pant 10 is thus adapted to cover the lower torso and upper legs of a wearer.

As can be seen in FIG. 1, the leg portions 14 include a plurality of thigh protective pads 18 which are integrally sewn thereto. The thigh protective pads 18 are substantially small and disposed in close proximity to one another and separated by seams 20 which define flexible fold lines minimizing the interference of the pant 10 with the motions of the wearer. Alternately, the thigh protective pads 18 could be received in corresponding pockets of the leg portions 14, detachably or permanently connected to the leg portion 14 on an outer surface or inner surface thereof, replaced by a single, larger flexible pad, etc. The thigh protective pads 18 are disposed such as to at least partially cover the upper legs or thighs of the wearer.

The torso portion 12 includes two hip protective pads 22, one on each side of the pant 10, which are interconnected by an elongated rear protective pad 24 extending across the lower back of the wearer as shown in FIG. 2. In a particular embodiment, the rear protective pad 24 is permanently connected along its length to the torso portion 12 of the pant 10, and the hip protective pads 22 are permanently connected to the torso portion 12 only along a top edge 26 thereof, such as to be free to flap upwards to allow an increased range of movement to the wearer. Alternately, the rear and hip protective pads 22,24 could be otherwise attached, whether permanently or removably, to the torso portion 12 of the pant 10. The hip protective pads 22 are disposed such as to at least partially cover the hips of the wearer.

Referring to FIG. 2, the torso portion 12 also includes a plurality of lower back protective pads 28 which are integrally sewn thereto. The lower back protective pads 28 are substantially small and include center pads 30 disposed downward of the rear protective pad 24 in close proximity to one another, and arcuate pads 32 forming an arc of circle around and in proximity of the center pads 30. Seams 20 separate adjacent pads 28 to define flexible fold lines minimizing the interference of the pant 10 with the motions of the wearer. Alternately, the lower back protective pads 28 could be received in corresponding pockets of the torso portion 12, detachably or permanently connected to the torso portion 12 on an outer surface or inner surface thereof, replaced by a single, larger flexible pad, etc. The lower back protective pads 28 are disposed such as to at least partially cover the lower back of the wearer.

Referring to FIGS. 1-2, the torso portion 12 further includes a waist protective pad 34 protruding upwardly therefrom, which has a tapered form toward the front of the pant 10, the higher back portion thereof defining a dorsal protective pad 36. The waist and dorsal protective pads 34,36 form an integral upper part of the torso portion 12. Alternately, the waist and dorsal protective pads 34,36 can be detachable from the pants 10 or connected in another adequate manner.

Referring to FIG. 1, the pant 10 also include means for retaining the pants 10 to the wearer, shown here as a belt 38 which can be tightened around the waist through the use of a buckle 40. Numerous other means are also possible including, for example, an elastic waist band.

In an alternate embodiment, one or more of the above-described protective pads 18,22,24,28,34,36 could be omitted. Other pads could also be added as required.

Referring to FIGS. 1 and 2, each leg portion 14 includes a front attachment member 42 (FIG. 1) and a rear attachment member 44 (FIG. 2) on an outer surface thereof, in proximity of the open end 16. Alternately, more or less such attachment members 42,44 can be provided. The attachment members 42,44 form one half of a detachable attachment system. For example, in the embodiment shown, the attachment members are one of a hook portion and a loop portion of a hook and loop type fastener such as Velcro™. Alternate types of attachment systems include, for example, snaps, buttons and buttonholes, zippers, metal hooks and loops, etc.

Still referring to FIGS. 1 and 2, the pant 10 is generally worn in combination with a pair of socks 45, only an upper portion 46 of one sock 45 being shown here. The socks 45 can be formed of a tubular portion only, or alternately can include at a bottom thereof a foot portion for containing a foot of the wearer. A front attachment member 48 (FIG. 1) and a rear attachment member 50 (FIG. 2) extend from an upper end 52 of the upper portion 46 of each sock 45, substantially diametrically opposed to one another. Alternately, more or less such attachment members 48,50 can be provided. The sock attachment members 48,50 form the other, complementary half of the attachment system of the pant attachment members 42,44. For example, in the embodiment shown, the sock attachment members 48,50 include the portion of the hook and loop type fastener complementary to the fastener portion of the pant attachment members 42,44.

As such, each sock 45 is attached to the pant 10 by engaging the sock and pant front attachment members 42,48 together, and the sock and pant rear attachment members 44,50 together. In the embodiment shown, the upper end 52 of the upper sock portion 46 is pulled around a lower end 53 of the leg portion 14 such as to surround it, although such a configuration is not necessary.

Figure 3:
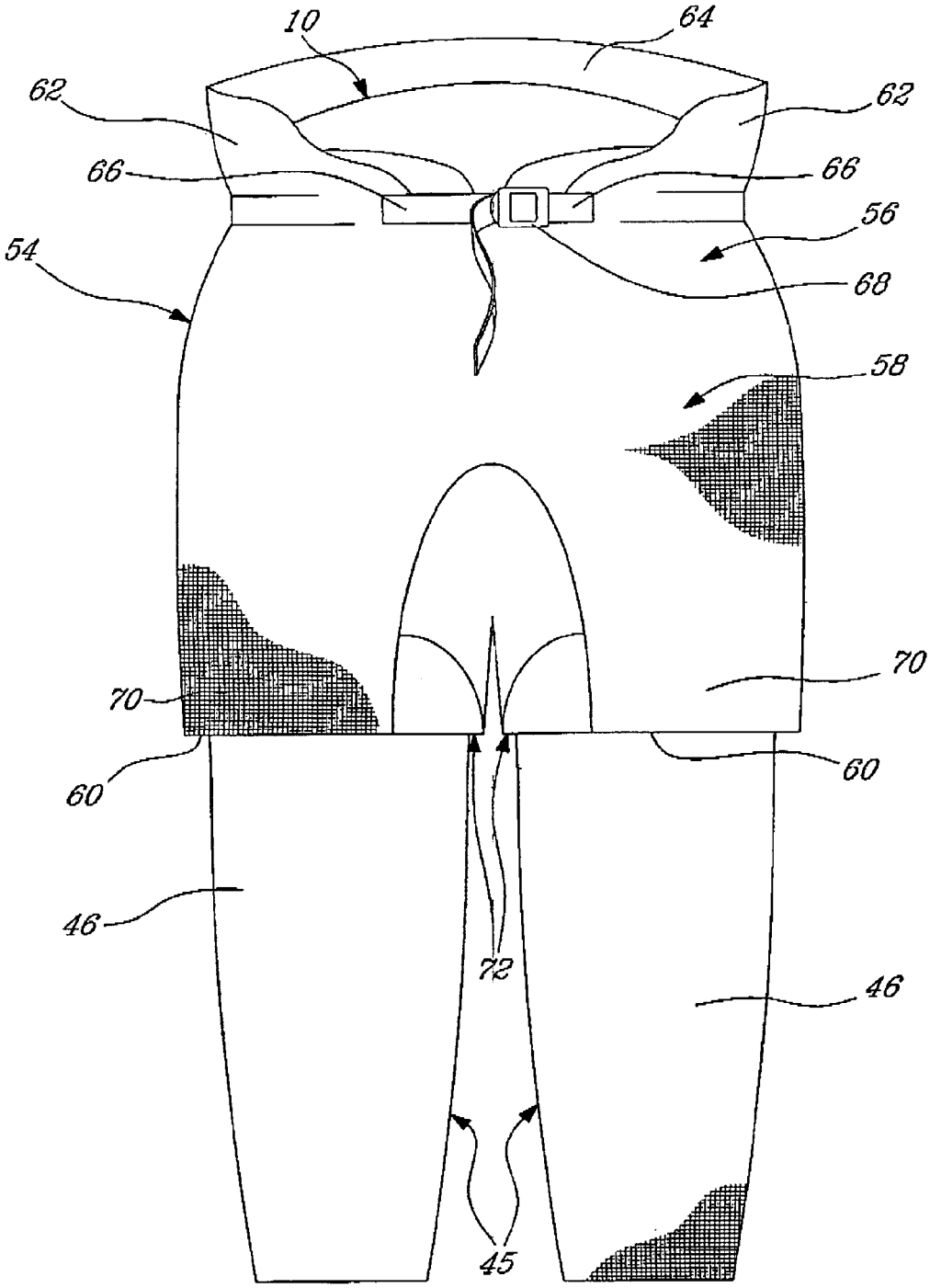
FIG. 3 is a front view of the hockey pant and sock portion of FIG. 1, with the pant being covered by an outer shell.

Referring to FIG. 3, an outer shell or outer pant 54 can be provided to cover the pant 10. The outer shell 54 generally includes a shell torso portion 56, which has a substantially tubular form, and a pair of shell leg portions 58, which also have a substantially tubular form and which extend from the shell torso portion 56 in communication therewith. Each shell leg portion 58 has an open end 60 defined opposite of the shell torso portion 56. The outer shell 54 is thus adapted to cover the torso and leg portions 12,14 of the inner pant 10.

The outer shell can also include protective pads such as, for example, rib protective pads 62 extending from each side thereof integral and continuous with a back protective pad 64 extending from the back thereof, or various other pads which can cooperate with the protective pads 18,22,24,28,34,36 of the inner pant 10. Alternately, the outer shell 54 can be free of any pads. The outer shell 54 can include various indicia such as team logos and provide the distinctive uniform look for the pants 10.

The outer shell 54 also include means for retaining it around the inner pant 10, one example being shown here as two straps 66 interconnected by a buckle 68. Numerous alternate means are also possible.

The outer shell 54 can thus be completely independent from the inner pant 10, i.e. either completely separate therefrom or alternatively detachably connected thereto, for example along a waistband, etc. such as to allow the wearer to change his/her uniform without replacing the relatively expensive inner, padded pants 10, but merely by replacing the outer shell 54. The outer shell 54 can also partially connected to the inner pant 10, although in this case the outer shell 54 cannot be replaced separately from the inner pant 10.

In any event, the outer shell 54 is independent (i.e. completely separate or detachably connected) from the pant 10 along at least regions 70 of the shell leg portions 58 defined from the open end 60 thereof and covering the attachment members 42,44 of the pants 10. Such a configuration allows the outer shell 54 to be separated from the inner pant 10 around the attachment members 42,44 to gain access thereto for attaching or detaching the socks 45.

Figure 4:
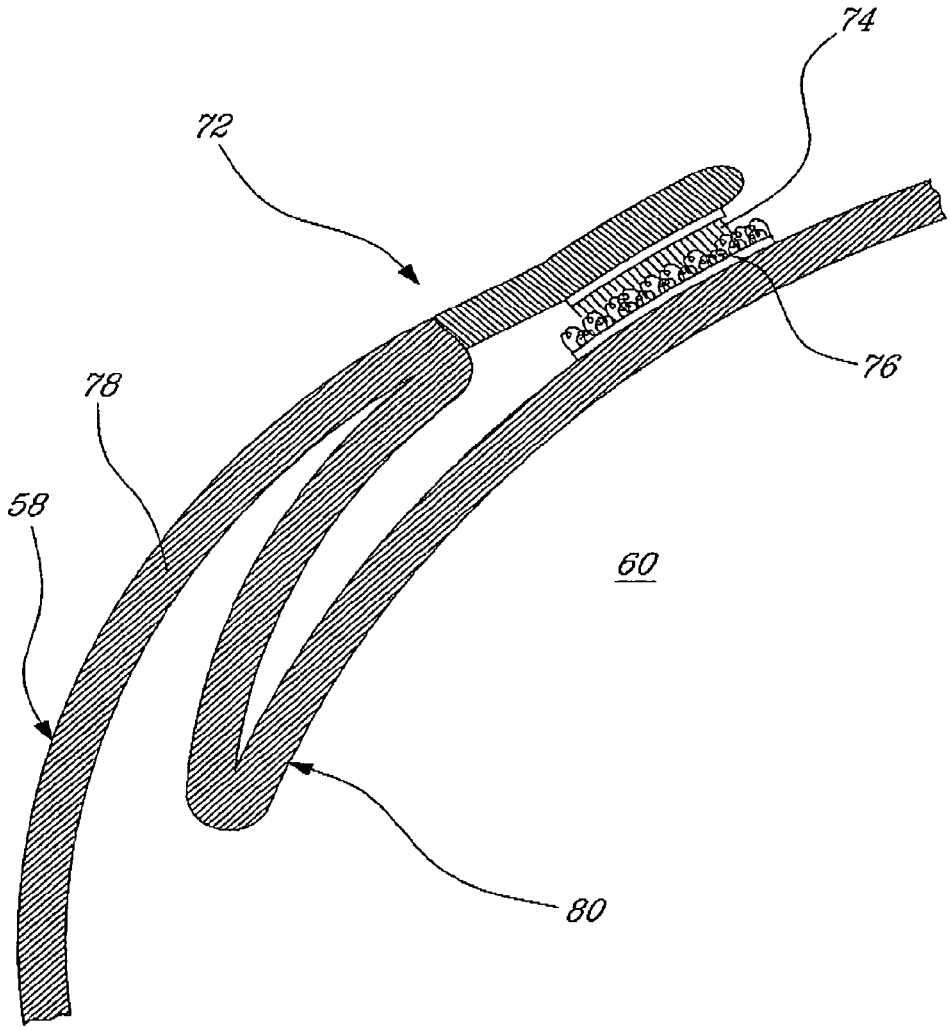
FIG. 4 is a partial, enlarged bottom view of an open end of the outer shell of FIG. 3.

The outer shell 54 includes, along a border 78 of each shell leg portion 58 extending around the open end 60, adjustment means 72 for selectively varying a perimeter of the open end 60. Referring to FIG. 4, the adjustment means 72 include for example complementary connecting members 74,76 attached to the border 78. The connecting members 74,76 become aligned with one another when the border 78 is folded, such as in 80, and the connecting members 74,76 are detachably connected to reduce the perimeter of the open end 60. Thus, by separating the connecting members 74,76, the border 78 can be extended by unfolding the fold 80 to enlarge the perimeter of the open end 60, facilitating access to the attachment members 42,44 of the inner pant 10 underneath. The connecting members 74,76 can be, for example, hook and loop type fasteners. Alternate connecting members 74,76 can be used, for example snaps, buttons and buttonholes, zippers, etc. Also, alternate adjustment means 72 can be used, one example being an elastic band in the border 78 and extending around the open end 60.

In one particular embodiment, the inner pant 10 is worn alone, without being covered by the outer shell 54. In this case, the inner pant 10 forms a visible part of the uniform of the player, and as such can include various indicia such as, for example, a team logo or team colors. The pant 10, even used alone, provides for an easy, simple way of attaching and retaining socks 45 thereto, eliminating the need for a garter belt.

In another particular embodiment, no socks 45 need to be retained directly on the pants 10. In this case, the pant attachment members 42,44 can be omitted. The outer shell 54 is independent from the inner pant 10, whether completely separate therefrom or detachably connected thereto. Such a configuration allows for an easy change of uniform by replacing only the outer shell 54, without the need to replace the inner, padded pant 10.

The embodiments of the invention described above are intended to be exemplary. Those skilled in the art will therefore appreciate that the foregoing description is illustrative only, and that various alternate configurations and modifications can be devised without departing from the spirit of the present invention. Accordingly, the present invention is intended to embrace all such alternate configurations, modifications and variances which fall within the scope of the appended claims.

The invention claimed is:

1. A garment comprising:

a pant having a torso portion adapted to cover a lower torso of a wearer, two tubular leg portions extending from the torso portion in communication therewith to cover upper legs of the wearer, the leg portions each having an open end opposed from the torso portion, means for retaining the pant in place around the torso, at least one of hip protective pads, a lower back protective pad and thigh protective pads, and at least one attachment member integral with each of the leg portions proximal the open end thereof and forming one half of a detachable attachment system;

an outer shell having a shell torso portion covering the torso portion of the pant, two tubular shell leg portions extending from the shell torso portion in communication therewith to cover the leg portions of the pant, the pant and the outer shell having substantially the same length, the shell leg portions each having one open end opposed from the shell torso portion, means for retaining the outer shell in place around the pant, and the outer shell being independent from the pant along at least a region of each shell leg portion defined from the open end thereof and covering the at least one attachment member such as to provide access to the at least one attachment member; and a pair of socks, each of the socks having at least one additional attachment member attached thereto forming the other half of the detachable attachment system, each additional attachment member of each sock being detachably connected to one of the at least one attachment member of a corresponding one of the leg portions.

2. The garment according to claim 1, wherein the outer shell is detachably connected to the pant.

3. The garment according to claim 1, wherein the outer shell is completely separate from the pant.

4. The garment according to claim 1, wherein the attachment members are complementary halves of a hook and loop type fastener.

5. The garment according to claim 1, wherein the outer shell includes at least one additional protective pad cooperating with the protective pads of the pant.

6. The garment according to claim 1, wherein each of the shell leg portions includes adjustment means around the open end thereof for selectively varying a perimeter of the open end.

7. The garment according to claim 6, wherein the adjustment means include complementary connecting members attached to a border of the shell leg portion surrounding the open end thereof, the complementary connecting members being aligned and detachably connectable to one another when the border is folded such as to reduce the perimeter of the open end of the shell leg portion.

8. The garment according to claim 1, wherein the at least one additional attachment member extends directly from an upper end of a respective one of the socks.

9. The garment according to claim 1, wherein the at least one attachment member includes at least two attachment members integral with each of the leg portions.

10. The garment according to claim 9, wherein the at least two attachment members includes at least opposed front and back attachment members integral with each of the leg portions, and the at least one additional attachment member includes at least opposed front and back attachment members provided on each of the socks.

11. The garment according to claim 1, wherein each additional attachment member is provided on a tab extending upwardly beyond an upper edge of a respective one of the socks.

12. A kit comprising:

a pair of socks, each of the socks comprising at least one first attachment member extending from an upper portion thereof;

an inner pant having a torso portion, two tubular leg portions extending from the torso portion in communication therewith and means for retaining the inner pant in place around a body of a wearer, at least one of the torso portion and leg portion including at least one protective pad, the leg portions each having an open end opposed from the torso portion, each of the leg portions including at least one second attachment member for each first attachment member of a corresponding one of the socks, the second attachment member being integral with the leg portion proximal the open end and being complementary to the corresponding first attachment member for forming a detachable connection; and an outer pant having an outer torso portion to cover the torso portion of the inner pant, two tubular outer leg portions extending from the outer torso portion in communication therewith to cover the leg portions of the inner pant, the inner and outer pant having substantially the same length, and means for retaining the outer pant in place around the inner pant, the outer leg portions each having an open end opposed from the outer torso portion, the outer pant being independent from the inner pant along at least a region of each outer leg portion defined from the open end thereof and covering the at least one second attachment member such as to provide access to the at least one second attachment member.

13. The kit according to claim 12, wherein the outer pant is completely independent from the inner pant.

14. The kit according to claim 12, wherein the upper portion of each sock is sized to surround a corresponding one of the leg portions around the open end thereof.

15. The kit according to claim 12, wherein at least one of the outer torso portions and the outer leg portions includes at least one additional protective pad cooperating with the at least one protective pad of the inner pant.

16. The kit according to claim 12, wherein each attachment member includes one of a hook portion and a loop portion of a hook and loop type fastener, and each second attachment member includes the other of the hook and loop portions.

17. The kit according to claim 12, wherein each of the outer leg portions include adjustment means around the open end thereof for selectively varying a perimeter thereof.

18. The kit according to claim 17, wherein the adjustment means include cooperating attachment members attached to a border of the outer leg portion surrounding the open end thereof, the cooperating attachment members being aligned and engagable when the border is folded such as to reduce the perimeter.

19. The kit according to claim 12, wherein the at least one protective pad includes at least one of hip protective pads, a lower back protective pad and thigh protective pads.

20. The kit according to claim 12, wherein the at least one second attachment member includes at least two second attachment members integral with each of the leg portions.

21. The kit according to claim 20, wherein the at least two second attachment members includes at least opposed front and back second attachment members integral with each of the leg portions, and the at least one first attachment member includes at least opposed front and back first attachment members extending from the upper portion of each of the socks.

22. The kit according to claim 12, wherein the at least one first attachment member is provided on a tab extending upwardly beyond an upper edge of a respective one of the sock.

* * * * *